US009440340B2

(12) United States Patent
Hsu et al.

(10) Patent No.: US 9,440,340 B2
(45) Date of Patent: Sep. 13, 2016

(54) ELECTRIC RIVET NUT TOOL AND CONTROL DEVICE THEREOF

(71) Applicant: Techway Industrial Co., Ltd., Taichung (TW)

(72) Inventors: Chih-Hua Hsu, Taichung (TW); Hong-Yao Chen, Taichung (TW); Liang-Huan Chen, Taichung (TW); Tain-Meei Lee, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 109 days.

(21) Appl. No.: 14/301,654

(22) Filed: Jun. 11, 2014

(65) Prior Publication Data

US 2015/0360355 A1 Dec. 17, 2015

(51) Int. Cl.
*B25B 23/147* (2006.01)
*B25B 27/00* (2006.01)

(52) U.S. Cl.
CPC ..... *B25B 23/147* (2013.01); *B25B 27/0014* (2013.01)

(58) Field of Classification Search
CPC ..... B25B 23/147; B25B 21/002; B25B 27/0014
See application file for complete search history.

(56) References Cited

U.S. PATENT DOCUMENTS 4,321,814 A * 3/1982 Martin ..... B21J 15/043 72/114
4,462,240 A * 7/1984 Yamamoto ..... B25B 27/0014 29/243.524
5,848,655 A * 12/1998 Cooper ..... B25B 21/02 173/117
6,357,101 B1 * 3/2002 Sarh ..... B21J 15/10 29/34 B
2005/0279198 A1 * 12/2005 Kushida ..... B25B 21/00 81/469
2006/0180630 A1 * 8/2006 Lin ..... B25B 27/0014 227/51
2007/0180959 A1 * 8/2007 Tokunaga ..... B25B 21/00 81/474
2007/0205733 A1 * 9/2007 Kawada ..... B62D 5/0481 318/432
2008/0190246 A1 * 8/2008 Hsu ..... B25B 23/147 81/57.13
2009/0194305 A1 * 8/2009 Xu ..... B25B 21/00 173/48
2010/0244754 A1 * 9/2010 Marumoto ..... H02P 25/021 318/400.11
2011/0239449 A1 * 10/2011 Masugata ..... B21J 15/043 29/715
2013/0264087 A1 * 10/2013 Harada ..... B25B 21/00 173/213

* cited by examiner

*Primary Examiner* — Shawki S Ismail
*Assistant Examiner* — Muhammad S Islam
(74) *Attorney, Agent, or Firm* — C. G. Mersereau & Nikolai & Mersereau, P.A.

(57) ABSTRACT

An electric rivet nut tool has a motor, a torque adjuster and a control device. The control device drives the motor to rotate a driving shaft so as to set a rivet nut. The torque adjuster serves to adjust a preset torque value. When a torque generated by the driving shaft exceeds the preset torque value of the torque adjuster and it represents that the rivet nut setting job is completed, the torque adjuster then displace for the control device to detect the displacement and drive the motor to reversely rotate. Given the torque adjuster and the control device, the problems of being time-consuming, inefficient, increasing in cost and damage prone to rivet nut or motor upon setting rivet nut because of the manual switch of forward or reverse rotation of an electric rivet nut tool can be effectively resolved.

16 Claims, 6 Drawing Sheets

ELECTRIC RIVET NUT TOOL AND CONTROL DEVICE THEREOF

BACKGROUND OF THE INVENTION

1. Field of the Invention

The present invention relates to an electric rivet nut tool, and more particularly to an electric rivet nut tool that automatically rotates a motor of the tool to release from a rivet nut after the completion of setting the rivet nut.

2. Description of the Related Art

When there is a need for multiple metal sheets to be joined and riveted, rivet nut is another choice to do the job in addition to nail or rivet. Rivet nut is tubular, is internally threaded, and penetrates through a hole formed through the metal sheets to be joined. Each rivet nut has a head and a body. The head is formed on and radially outwardly protrudes from a periphery of one end of the rivet nut. The body is tubular and internally threaded, is formed on the head and protrudes in a direction toward the other end of the rivet nub, and has a deformable portion formed on a free end of the body. An electric rivet nut tool rotates the body of a rivet nut through a nose piece engaging the internally threaded portion of the body of the rivet nut such that the deformable portion is deformed by a resulting shear and the deformable portion and the head of the rivet nut bind two sheet metals penetrated through by the rivet nut. When the rivet nut is set, the electric rivet nut tool automatically stops rotation of a motor thereof through a safety circuit loop and a forward/reverse button on the rivet nut tool can be manually switched to reversely rotate the motor and separate the electric rivet nut tool from the rivet nut.

From the foregoing, disadvantages of the conventional rivet nut tools can be listed below.

1. The forward/reverse button needs to be manually switched for the motor to forwardly rotate a rivet nut to a designated position and reversely rotate to release the conventional rivet nut tools from the rivet nut. Such manual operation consumes more time and is less efficient in operation.
2. As rivet nuts may be of different specifications, rivet nuts of different specifications need to be set with different torques. Higher torque may damage smaller rivet nuts upon driving them while lower torque may overdrive the motor upon driving larger rivet nuts. Hence, the life durations of the motor of the conventional rivet nut tools are shortened.

SUMMARY OF THE INVENTION

An objective of the present invention is to provide an electric rivet nut tool and a control device thereof capable of resolving the problems of being time-consuming, inefficient, increasing in cost and damage prone to rivet nut or motor upon setting rivet nut because of the manual switch of forward or reverse rotation of an electric rivet nut tool.

To achieve the foregoing objective, the electric rivet nut tool has a body, a DC (Direct Current) power supply module, a DC motor, a torque adjuster and a control device.

The DC power supply module is mounted inside the body.

The motor is mounted inside the body and has a spindle.

The torque adjuster is mounted inside the body and has a pressing disc, a steel ball disc and a spring.

The pressing disc is connected with the body.

The steel ball disc has a driving shaft mounted through the steel ball disc and driven by the DC motor.

The spring is mounted between and is squeezed by the pressing disc and the steel ball disc.

The control device is mounted inside the body and has a forward/reverse rotation module, a switching module and a control module.

The forward/reverse rotation module has an input port, an output port and at least one control port.

The input port is electrically connected to the DC power supply module.

The output port is electrically connected to the DC motor.

The switching module has an input terminal, an output terminal and a control terminal.

The input terminal and the output terminal are connected in series between the input port of the forward/reverse rotation module and the DC power supply module.

The control module is electrically connected to the control port of the forward/reverse rotation module and the control terminal of the switching module, receives a reverse rotation signal to control the forward/reverse rotation module to drive the DC motor to reversely rotate, and controls the switching module to turn on or turn off.

The torque measurement unit is electrically connected to the control module, detects a movement of the steel ball disc of the torque adjuster. The movement of the steel ball disc is used to determine if a torque outputted from the driving shaft of the torque adjuster is greater than a preset value. The torque measurement unit sends the reverse rotation signal to the control module of the control device if the torque is greater than the preset value.

To achieve the foregoing objective, the control device is connected with an electric rivet nut tool and has a forward/reverse rotation module, a switching module, a control module and a torque measurement unit.

The forward/reverse rotation module has an input port, an output port and at least one control port.

The input port is adapted to electrically connect to a DC (Direct Current) power source.

The output port is adapted to electrically connect to a DC motor.

The switching module has an input terminal, an output terminal and a control terminal.

The input terminal and the output terminal are connected in series between the input port of the forward/reverse rotation module and the DC power source.

The control module is electrically connected to the control port of the forward/reverse rotation module and the control terminal of the switching module, receives a reverse rotation signal to control the forward/reverse rotation module to drive the DC motor to reversely rotate, controls the switching module to turn on or turn off, and has multiple input/output (I/O) ports.

The torque measurement unit is electrically connected to the control module, detects a torque of the DC motor upon forwardly rotating to determine if the torque is greater than a preset value, and sends a reverse rotation signal to the control module if the torque is greater than the preset value.

Given the forgoing electric rivet nut tool and control device, the control device of the electric rivet nut tool drives the DC motor to forwardly rotate, the driving shaft drives a body of a rivet nut to set the rivet nut. The pressing disc and the spring serve to adjust a desired preset torque value. When the torque generated by the driving shaft exceeds the compression force of the spring exerted on the steel ball disc, it represents that the torque outputted from the driving shaft has already exceeded the preset torque value and the steel ball disc displaces for the torque measurement unit to sense and output the reverse rotation signal to the control device. The control module of the control device then drives the DC motor to reversely rotate for the electric rivet nut tool to be separated from the rivet nut. Therefore, the problems of conventional electric rivet tools being time-consuming, inefficient, increasing in cost and damage prone to rivet nut or motor upon setting rivet nut can be effectively resolved.

Other objectives, advantages and novel features of the invention will become more apparent from the following detailed description when taken in conjunction with the accompanying drawings.

DETAILED DESCRIPTION OF THE INVENTION

Figure 1:
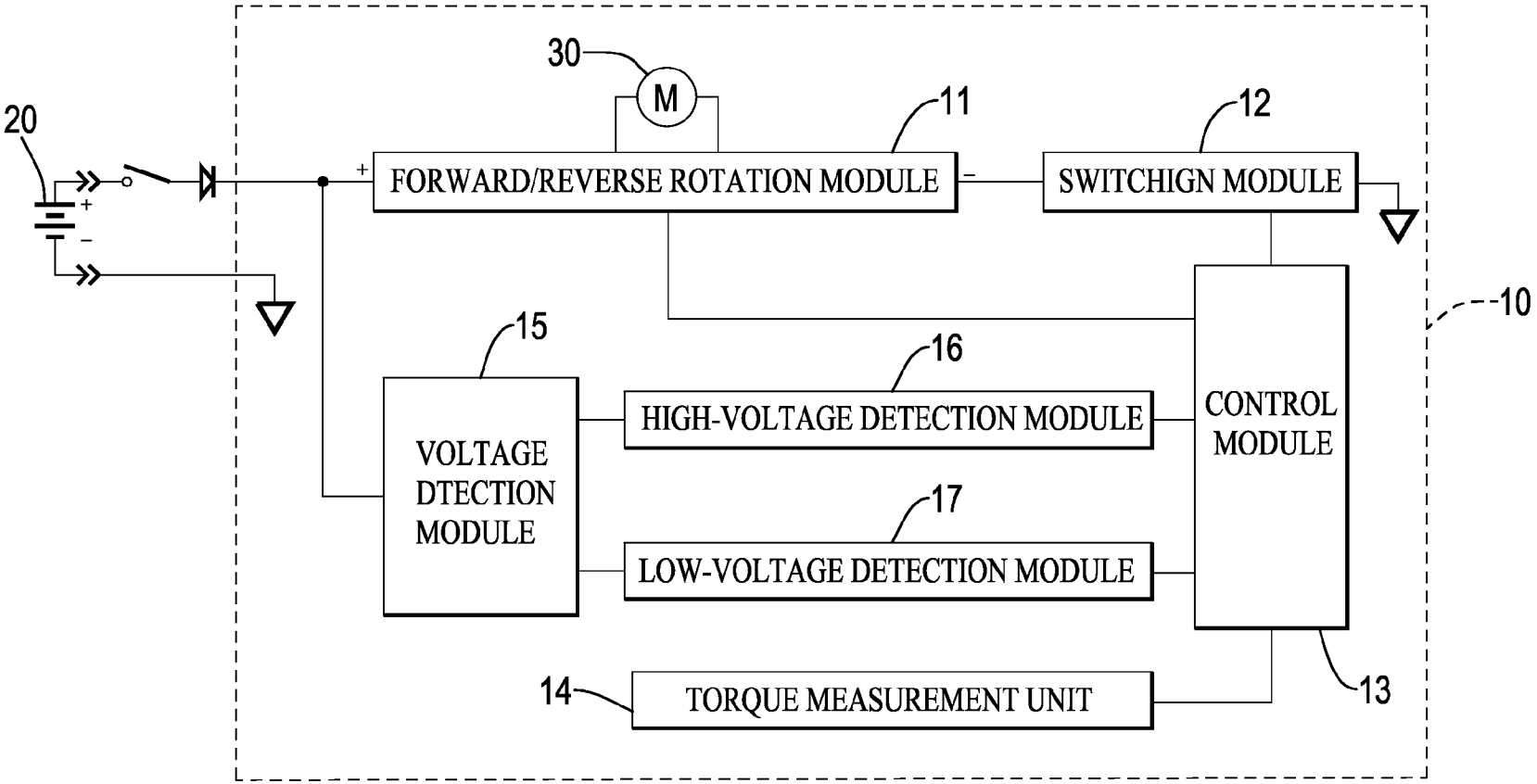
FIG. 1 is a functional circuit diagram of an electric rivet nut tool in accordance with the present invention.
Figure 2:
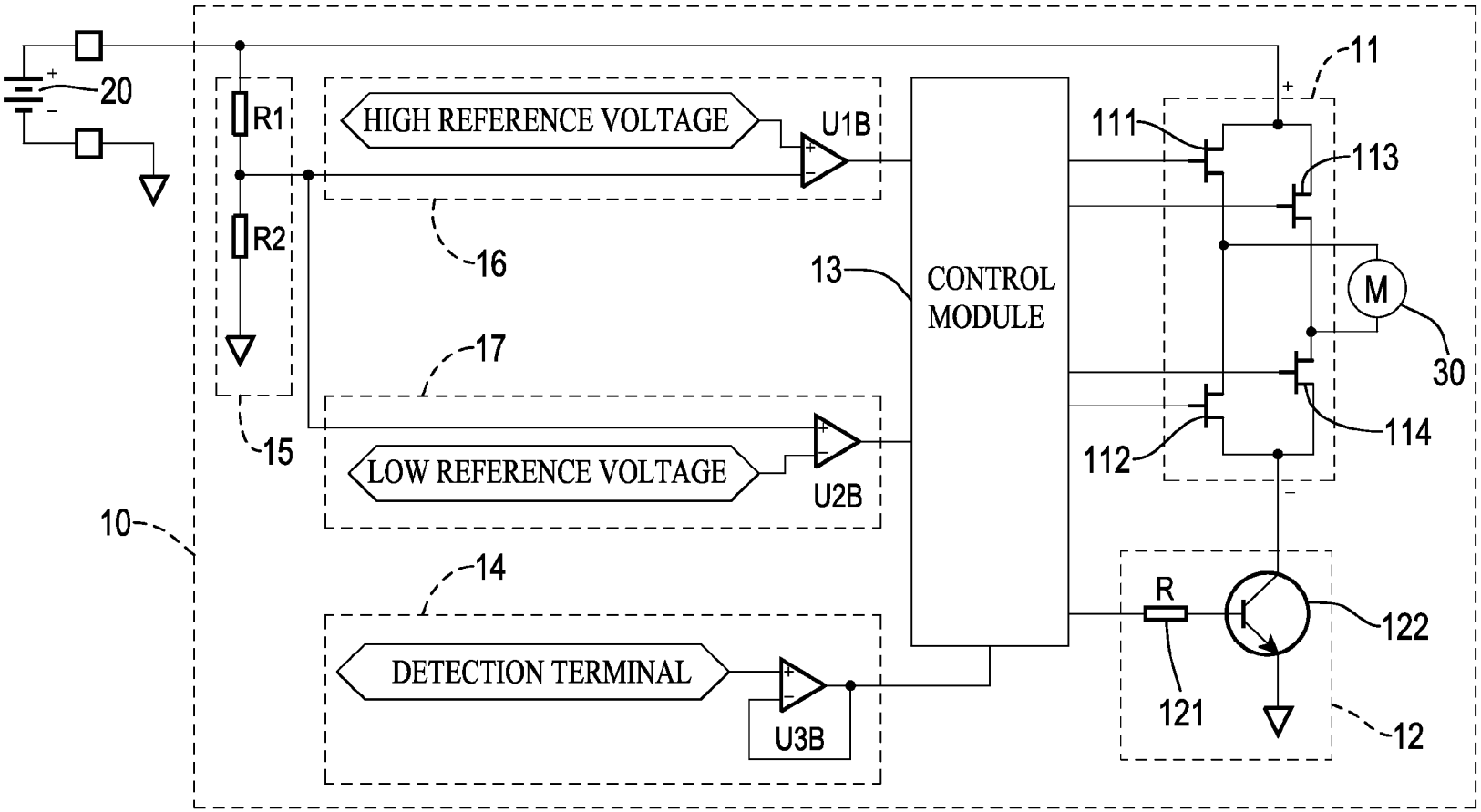
FIG. 2 is a circuit diagram of the electric rivet nut tool in FIG. 1.

With reference to FIGS. 1 and 2, a control device 10 of an electric rivet nut tool in accordance with the present invention has a forward/reverse rotation module 11, a switching module 12, a control module 13 and a torque measurement unit 14. The control module 13 is electrically connected to the forward/reverse rotation module 11, the switching module 12 and the torque measuring module 14. The forward/reverse rotation module 11 has an input port (a positive terminal (+) and a negative terminal (−)), an output port and at least one control port. The positive terminal and the negative terminal of the input port are respectively electrically connected to a positive terminal (+) and a negative terminal (−) of an external DC (Direct Current) power source 20. The output port (two load terminals) is electrically connected to a DC motor 30 The DC power source 20 has multiple batteries. The negative terminal (−) of the DC power source 20 is also a ground terminal.

The forward/reverse rotation module 11 has four driving transistors 111, 112, 113, 114. Each driving transistor 111~114 has a gate, a drain and a source. The driving transistors 111~114 are mutually connected in the form of a bridge. In other words, the source of one 111 of a first pair 111, 112 of the driving transistors 111~114 is connected to the drain of the other one 112 of the first pair 111, 112 of the driving transistors 111~114, and a second pair 113, 114 of the driving transistors 111~114 is connected in a similar fashion. The outmost drain and source of the first pair 111, 112 or the second pair 113, 114 of the driving transistors 111~114 are taken as the positive terminal and the negative terminal of the forward/reverse rotation module. A series-connected node between the driving transistors of first pair 111, 112 and a series-connected node between the driving transistors of the second pair 113, 114 are taken as the two load terminals of the forward/reverse rotation module 11 that are electrically connected to the DC motor 30. The gate of each driving transistor 111-114 is taken as one of the at least one control port of the forward/reverse rotation module 11 and is electrically connected to the control module 13.

The switching module 12 has an input terminal, an output terminal and a control terminal. The input terminal of the switching module 12 is electrically connected to the negative terminal (−) of the input port of the forward/reverse rotation module 11. The output terminal of the switching module 12 is electrically connected to the negative terminal (−) of the DC power source 20. The control terminal is electrically connected to the control module 13. The switching module 12 has a resistor 121 and a switching transistor 122. In the present embodiment, the switching transistor 122 is a bipolar junction transistor (BJT) having a base, a collector and an emitter. One end of the resistor 121 is connected to the base of the switching transistor 122, and the other end of the resistor 121 is taken as the control terminal of the switching module 12. The collector of the switching transistor 122 is taken as the input terminal of the switching module 12. The emitter of the switching transistor 122 is taken as the output terminal of the switching module 12 and is connected to the ground terminal.

The control module 13 is electrically connected to the control port of the forward/reverse rotation module 11 and the control terminal of the switching module 12. The control module 13 receives a forward/reverse control signal outputted from the torque measurement unit 14 to control the forward/reverse rotation module 11 such that the forward/reverse rotation module 11 drives the DC motor 30 to reversely rotate and controls the switching module 12 to turn off or turn on. In the present embodiment, when controlling the DC motor 30 to forwardly rotate, the control module sends a signal to the control port of the forward/reverse rotation module 11 to turn on two of driving transistors 111, 114 and further sends another signal to the control terminal of the switching module 12 to turn on the switching transistor 122 such that the DC power source 20, the forward/reverse rotation module 11, the DC motor 30 and the switching module 12 form a power loop for the DC motor 30 to forwardly rotate. When controlling the DC motor 30 to reversely rotate, the control module 13 turns on the other two driving transistors 112, 113 and the switching transistor 122 such that the DC power source 20 reversely supplies power to the DC motor 30 for the DC motor 30 to reversely rotate.

The torque measurement unit 14 detects a torque outputted from the DC motor 30 when the DC motor 30 forwardly rotates. When the torque is greater than a preset value, the torque measurement unit 14 outputs a reverse rotation signal to the control module 13. The torque measurement unit 14 has an operational amplifier (U3B). The operational amplifier (U3B) has a positive terminal taken as a detection terminal of the torque measurement unit 14 and a negative terminal connected to an output terminal of the operational amplifier (U3B).

The control device 10 further has a voltage detection module 15, a high-voltage detection module 16 and a low-voltage detection module 17. The voltage detection module 15 is electrically connected to the positive terminal (+) of the DC power source 20. The high-voltage detection module 15 is electrically connected to the control module 13 and the voltage detection module 15. The low-voltage detection module 17 is electrically connected to the control module 13 and the voltage detection module 14. The voltage detection module 15 serves to detect a voltage level or a voltage variation of the DC power source 20. The voltage detection module 15 has two resistors R1, R2 connected in series to form a voltage divider. An outer end of one of the two resistors R1 is connected to the positive terminal (+) of the DC power source 20, and an outer end of the other resistor R2 is connected to the negative terminal (−) of the DC power source 20. A series-connected node between the two resistors R1, R2 is taken as an output terminal of the voltage detection module 15. The high-voltage detection module 16 serves for high-voltage protection, and has an operational amplifier (U1B). The operational amplifier (U1B) has a positive terminal connected to a high reference voltage, a negative terminal connected to the output terminal of the voltage detection module 15, and an output terminal connected to an input/output (I/O) port of the control module 13. The low-voltage detection module 17 serves for low-voltage protection, and has an operational amplifier (U2B). The operational amplifier (U2B) has a positive terminal connected to the output terminal (+) of the voltage detection module 15, a negative terminal (−) connected to a low reference voltage, and an output terminal connected to another I/O port of the control module 13.

From the foregoing description, the control device 10 controls a rotation direction of the DC motor 30 through the control of the forward/reverse rotation module 11, and controls if the DC motor 30 operates through the control of the switching module 12. When receiving the reverse rotation signal from the torque measurement unit 14, the control module 13 controls the DC motor 30 to automatically reversely rotate instead of forwardly rotating such that time and operation effort required to manually operate a forward/reverse button can be eliminated.

Figure 3:
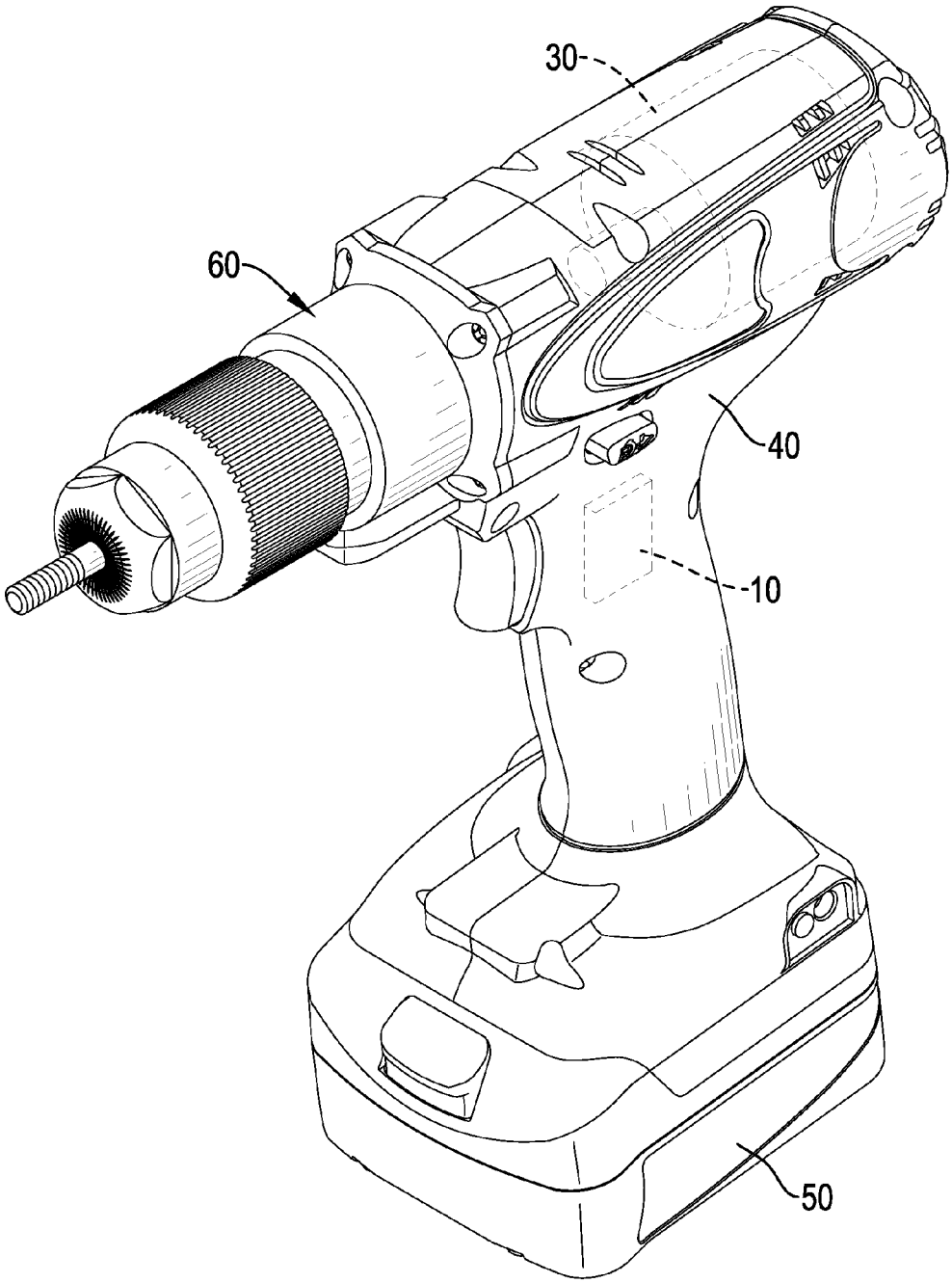
FIG. 3 is a perspective view of an electric rivet nut tool in accordance with the present invention.
Figure 4:
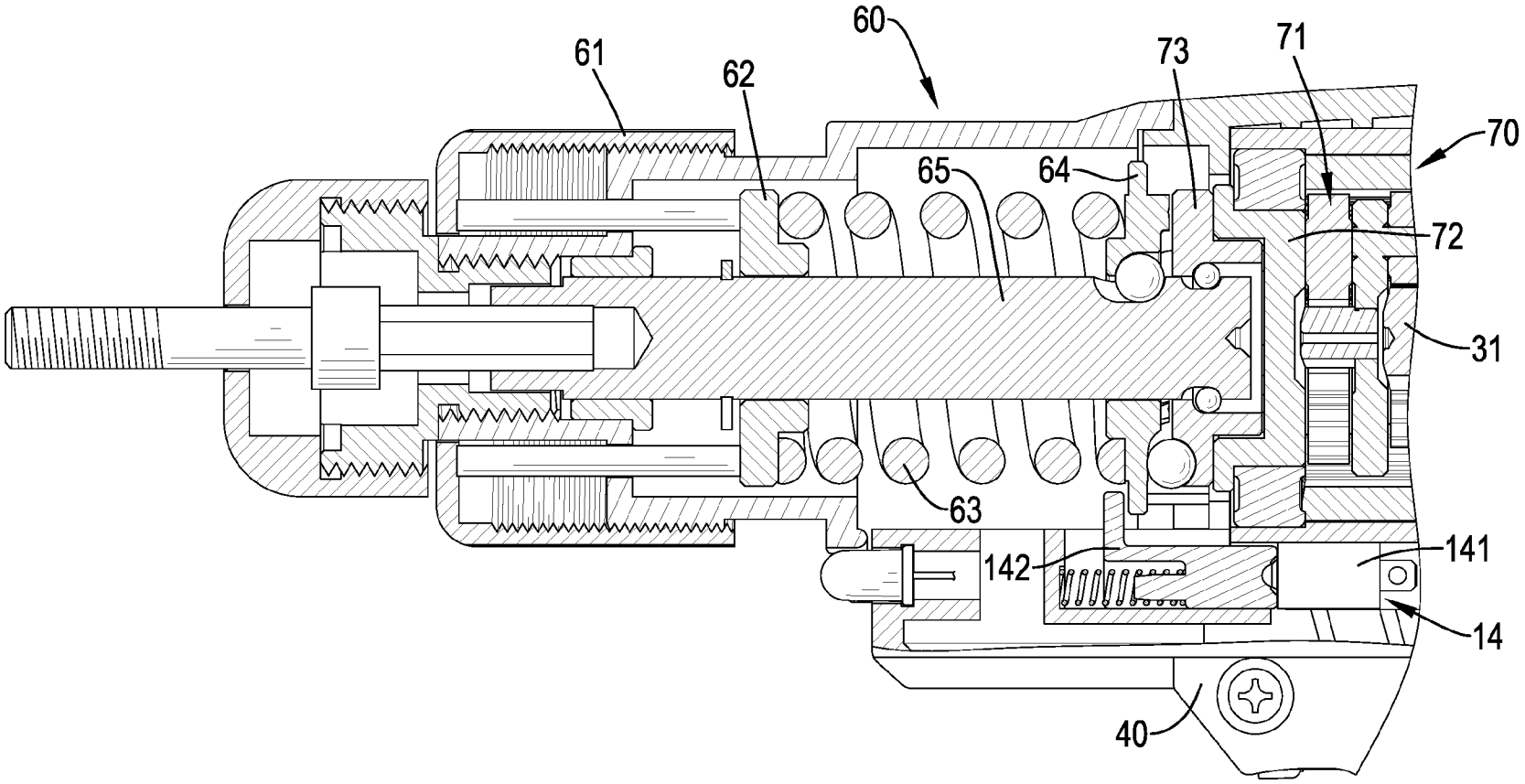
FIG. 4 is a partial cross-sectional view of the electric rivet nut tool in FIG. 3.

With reference to FIGS. 3 and 4, besides the aforementioned control device 10 and the DC motor 30, an electric rivet nut tool in accordance with the present invention further has a body 40, a DC power supply module 50, a speed reducer 70 and a torque adjuster 60.

The DC power supply module 50 may be a detachable and rechargeable battery pack. The DC motor 30 has a spindle 31.

The speed reducer 70 is mounted and connected between the spindle 31 of the DC motor 30 and the torque adjuster 60, and has a reduction gear set 71, an output disc 72 and a cam disc 73. In the present embodiment, the reduction gear set 71 is a planetary reduction gear set. The reduction gear set 71 has an input end connected to the spindle 31 of the DC motor 30 and an output end. The output disc 72 is connected to the output end of the reduction gear set 71. The cam disc 73 is connected with and driven by the output disc 72. The speed reducer 70 serves to convert a high-speed and low-torque output into a low-speed and high-torque output.

Figure 5:
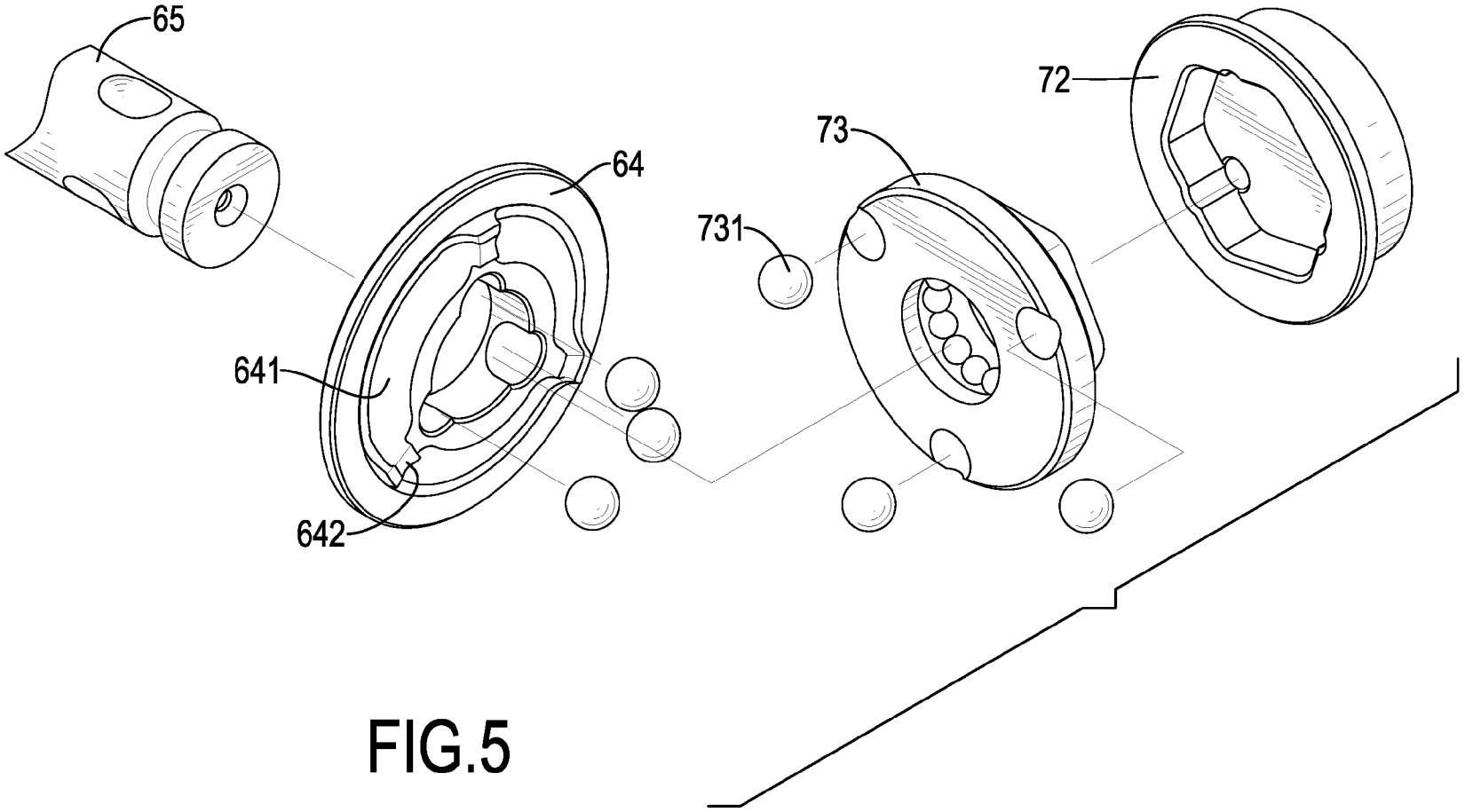
FIG. 5 is a partial exploded view of a torque adjuster in the electric rivet nut tool in FIG. 3.

The torque adjuster 60 has a housing, a torque adjustment ring 61, a pressing disc 62, a spring 63 and a steel ball disc 64. The housing is hollow and is connected to the body 40 to accommodate the pressing disc 62, the spring 63 and the steel ball disc 64. The torque adjustment ring 61 has an internally threaded portion to engage a threaded portion on an outer periphery of the housing. The pressing disc 62 is connected with the torque adjustment ring 61 and has a through hole centrally formed through the pressing disc 62. The spring 63 is mounted between and squeezed by the pressing disc 62 and the steel ball disc 64. The steel ball disc 64 has a driving shaft 65 mounted through the steel ball disc 64 and mounted in the cam disc 73. With reference to FIG. 5, the steel ball disc 64 has multiple guiding grooves 641 and multiple stoppers 642. The guiding grooves 641 and the stoppers 642 are annularly arranged on one side of the steel ball disc 64 facing the cam disc 73. Each stopper 642 is formed between adjacent two of the guiding grooves 641. Multiple steel balls 731 are held between the guiding grooves 641 and the cam disc 73. When the torque generated by the cam disc 73 is greater than a compression force of the spring 63 exerted on the steel ball disc 64, each steel ball 731 originally retained in one of the guiding grooves 641 can be slidably moved to pass through a corresponding stopper 642 such that the steel ball disc 64 is pushed to move in a direction away from the cam disc 73 and to disconnect from the cam disc 73. After passing through the corresponding stopper 642, each steel ball 731 enters the guiding groove 641 next to the original guiding groove 641 in which the steel ball 731 is retained.

Figure 6:
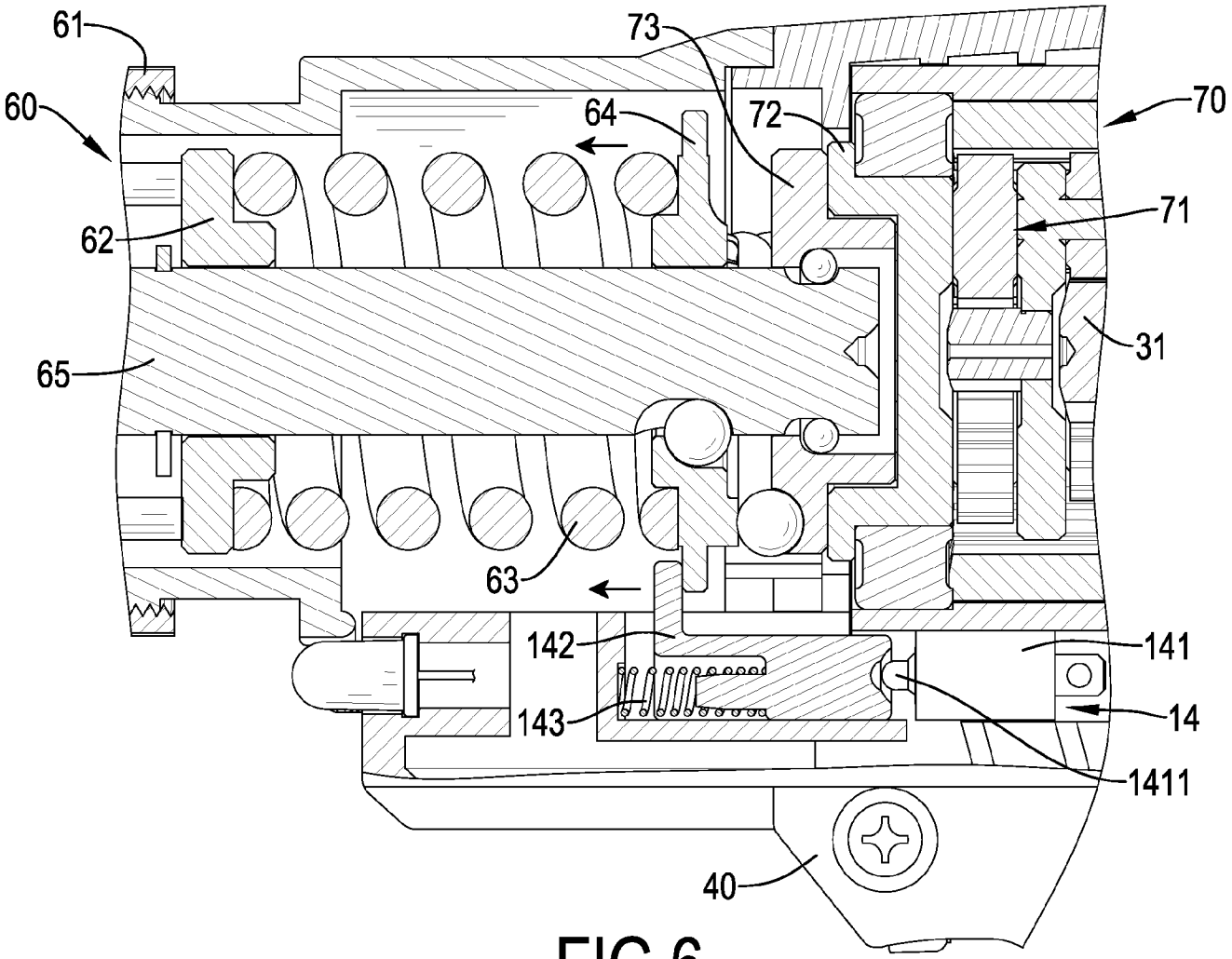
FIG. 6 is an operational partial cross-sectional view of the torque in FIG. 5.

With reference to FIG. 6, the torque measurement unit 14 is mounted inside the body 40, is located under the speed reducer 70, and serves to measure a displacement of the steel ball disc 64 of the torque adjuster 60. When the steel ball disc displaces (in a direction moving toward the left) and it represents that an output torque is greater than the preset value, the reverse rotation signal is outputted to the control device 10. The torque measurement unit 14 has a micro switch 141, a linkage member 142 and a thrust spring 143. The micro switch 141 is electrically connected to the detection terminal of the torque measurement unit 14, and has a pushing pin 1411 movably mounted in the micro switch 141. The reverse rotation signal is outputted according to a position to which the pushing pin 1411 is moved. The linkage member 142 is roughly L-shaped and has a long portion and a short portion. The short portion abuts against the steel ball disc 64. The long portion abuts against the pushing pin 1411 of the micro switch 141. The thrust spring 143 is mounted around a part of the long portion of the linkage member 142 and is located between the short portion of the linkage member 142 and the body 40. When the linkage member 142 subjected to a thrust from the steel ball disc 64 is separated from the micro switch 141, the pushing pin 1411 is moved out of the micro switch 141 such that different contact point of the micro switch 141 is activated and the reverse rotation signal is generated. When the linkage member 142 is not subjected to a thrust from the steel ball disc 64, the thrust spring 143 pushes the linkage member 142 to an original position thereof.

In sum, when the control device 10 of the electric rivet nut tool drives the DC motor 30 to forwardly rotate, the driving shaft 65 drives a rivet nut for rivet setting. The pressing disc 62 and the spring 63 serve to adjust a desired preset torque value. When the torque generated by the driving shaft 65 exceeds the compression force of the spring 63 exerted on the steel ball disc 64, it represents that the torque outputted from the driving shaft 65 already exceeds the preset torque value and the steel ball disc 64 displaces for the torque measurement unit 14 to output the reverse rotation signal to the control device 10. The control module 13 of the control device 10 then drives the DC motor 30 to reversely rotate for the electric rivet nut tool to be separated from the rivet nut. Accordingly, the problems of conventional electric rivet tools being time-consuming, inefficient, increasing in cost and damage prone to rivet nut or motor upon setting rivet nut can be effectively resolved.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An electric rivet nut tool, comprising:
a body;
a DC (Direct Current) power supply module mounted inside the body;
a DC motor mounted inside the body and having a spindle;
a torque adjuster mounted inside the body and having:
a pressing disc connected with the body;
a steel ball disc having a driving shaft mounted through the steel ball disc and driven by the DC motor; and
a spring mounted between and squeezed by the pressing disc and the steel ball disc; and
a control device mounted inside the body and having:
a forward/reverse rotation module having:
an input port electrically connected to the DC power supply module;
an output port electrically connected to the DC motor; and
at least one control port;
a switching module having:
an input terminal and an output terminal connected in series between the input port of the forward/reverse rotation module and the DC power supply module; and
a control terminal;
a control module electrically connected to the control port of the forward/reverse rotation module and the control terminal of the switching module, receiving a reverse rotation signal to control the forward/reverse rotation module to drive the DC motor to reversely rotate, and controlling the switching module to turn on or turn off; and
a torque measurement unit electrically connected to the control module, detecting a movement of the steel ball disc of the torque adjuster, wherein the movement of the steel ball disc is used to determine if a torque outputted from the driving shaft of the torque adjuster is greater than a preset value, and the torque measurement unit sends the reverse rotation signal to the control module of the control device if the torque is greater than the preset value.

2. The electric rivet nut tool as claimed in claim 1, wherein the torque adjuster further has:
a housing being hollow and connected to the body to accommodate the pressing disc, the spring and the steel ball disc; and
a torque adjustment ring engaging the housing and connected with the pressing disc.

3. The electric rivet nut tool as claimed in claim 2, further comprising a speed reducer, wherein the speed reducer is connected between the DC motor and the torque adjuster and has:
a reduction gear set having:
an input end connected with the spindle of the DC motor; and
an output end;
an output disc connected with the output end of the reduction gear set; and
a cam disc connected with the output disc and the steel ball disc of the torque adjuster.

4. The electric rivet nut tool as claimed in claim 3, wherein the steel ball disc has:
multiple guiding grooves annularly arranged on one side of the steel ball disc facing the cam disc;
multiple stoppers, each stopper formed between adjacent two of the guiding grooves, and
multiple steel balls held between the guiding grooves and the cam disc.

5. A control device connected with an electric rivet nut tool, the control device comprising:
a forward/reverse rotation module having:
an input port adapted to electrically connect to a DC (Direct Current) power source;
an output port adapted to electrically connect to a DC motor; and
at least one control port;
a switching module having:
an input terminal and an output terminal connected in series between the input port of the forward/reverse rotation module and the DC power source; and
a control terminal;
a control module electrically connected to the control port of the forward/reverse rotation module and the control terminal of the switching module, receiving a reverse rotation signal to control the forward/reverse rotation module to drive the DC motor to reversely rotate, controlling the switching module to turn on or turn off, and having multiple input/output (I/O) ports; and
a torque measurement unit electrically connected to the control module, detecting a torque of the DC motor upon forwardly rotating to determine if the torque is greater than a preset value, and sending a reverse rotation signal to the control module if the torque is greater than the preset value.

6. The control device as claimed in claim 5, wherein the forward/reverse rotation module has four driving transistors, each driving transistor has agate, a drain and a source, the source of one of a first pair of the driving transistors is connected to the drain of the other one of the first pair of the driving transistors, the source of one of a second pair of the driving transistors is connected to the drain of the other one of the second pair of the driving transistors, the outmost drain and source of the first pair or the second pair of the driving transistors are taken as the positive terminal and the negative terminal of the forward/reverse rotation module, a series-connected node between the driving transistors of the first pair and a series-connected node between the driving transistors of the second pair are electrically connected to the DC motor, and the gate of each driving transistor is taken as one of the at least one control port of the forward/reverse rotation module and is electrically connected to the control module.

7. The control device as claimed in claim 6, wherein the switching module has:
a resistor having one end taken as the control terminal of the switching module; and
a switching transistor being a bipolar junction transistor (BJT) having:
a base connected to the other end of the resistor;
a collector taken as the input terminal of the switching module; and
an emitter taken as the output terminal of the switching module.

8. The control device as claimed in claim 7, wherein the torque measurement unit has an operational amplifier, the operational amplifier has a positive terminal taken as a detection terminal of the torque measurement unit and a negative terminal connected to an output terminal of the operational amplifier.

9. The control device as claimed in claim 5, wherein the control device further has:
a voltage detection module electrically connected to the DC power source;

a high-voltage detection module electrically connected to the control module and the voltage detection module; and a low-voltage detection module electrically connected to the control module and the voltage detection module.

10. The control device as claimed in claim 6, wherein the control device further has:

a voltage detection module electrically connected to the DC power source;

a high-voltage detection module electrically connected to the control module and the voltage detection module; and a low-voltage detection module electrically connected to the control module and the voltage detection module.

11. The control device as claimed in claim 7, wherein the control device further has:

a voltage detection module electrically connected to the DC power source;

a high-voltage detection module electrically connected to the control module and the voltage detection module; and a low-voltage detection module electrically connected to the control module and the voltage detection module.

12. The control device as claimed in claim 8, wherein the control device further has:

a voltage detection module electrically connected to the DC power source;

a high-voltage detection module electrically connected to the control module and the voltage detection module; and a low-voltage detection module electrically connected to the control module and the voltage detection module.

13. The control device as claimed in claim 9, wherein the voltage detection module has two resistors connected in series to form a voltage divider, wherein an outer end of one of the two resistors and an outer end of the other resistor is connected to the DC power source, and a series-connected node between the two resistors is taken as an output terminal of the voltage detection module;

the high-voltage detection module has an operational amplifier, wherein the operational amplifier of the high-voltage detection module has:

a positive terminal connected to a high reference voltage;

a negative terminal connected to the output terminal of the voltage detection module; and an output terminal connected to one of the I/O ports of the control module;

the low-voltage detection module has an operational amplifier, wherein the operational amplifier of the low-voltage detection module has:

a positive terminal connected to the output terminal of the voltage detection module;

a negative terminal connected to a low reference voltage, and an output terminal connected to another I/O port of the control module.

14. The control device as claimed in claim 10, wherein the voltage detection module has two resistors connected in series to form a voltage divider, wherein an outer end of one of the two resistors and an outer end of the other resistor is connected to the DC power source, and a series-connected node between the two resistors is taken as an output terminal of the voltage detection module;

the high-voltage detection module has an operational amplifier, wherein the operational amplifier of the high-voltage detection module has:

a positive terminal connected to a high reference voltage;

a negative terminal connected to the output terminal of the voltage detection module; and an output terminal connected to one of the I/O ports of the control module;

the low-voltage detection module has an operational amplifier, wherein the operational amplifier of the low-voltage detection module has:

a positive terminal connected to the output terminal of the voltage detection module;

a negative terminal connected to a low reference voltage, and an output terminal connected to another I/O port of the control module.

15. The control device as claimed in claim 11, wherein the voltage detection module has two resistors connected in series to form a voltage divider, wherein an outer end of one of the two resistors and an outer end of the other resistor is connected to the DC power source, and a series-connected node between the two resistors is taken as an output terminal of the voltage detection module;

the high-voltage detection module has an operational amplifier, wherein the operational amplifier of the high-voltage detection module has:

a positive terminal connected to a high reference voltage;

a negative terminal connected to the output terminal of the voltage detection module; and an output terminal connected to one of the I/O ports of the control module;

the low-voltage detection module has an operational amplifier, wherein the operational amplifier of the low-voltage detection module has:

a positive terminal connected to the output terminal of the voltage detection module;

a negative terminal connected to a low reference voltage, and an output terminal connected to another I/O port of the control module.

16. The control device as claimed in claim 12, wherein the voltage detection module has two resistors connected in series to form a voltage divider, wherein an outer end of one of the two resistors and an outer end of the other resistor is connected to the DC power source, and a series-connected node between the two resistors is taken as an output terminal of the voltage detection module;

the high-voltage detection module has an operational amplifier, wherein the operational amplifier of the high-voltage detection module has:

a positive terminal connected to a high reference voltage;

a negative terminal connected to the output terminal of the voltage detection module; and an output terminal connected to one of the I/O ports of the control module;

the low-voltage detection module has an operational amplifier, wherein the operational amplifier of the low-voltage detection module has:

a positive terminal connected to the output terminal of the voltage detection module;

a negative terminal connected to a low reference voltage, and an output terminal connected to another I/O port of the control module.

* * * * *